US008662825B2

(12) United States Patent
Ireland et al.

(10) Patent No.: US 8,662,825 B2
(45) Date of Patent: Mar. 4, 2014

(54) COOLED AEROFOIL BLADE OR VANE

(75) Inventors: Peter T. Ireland, Derby (GB); Howoong Namgoong, Derby (GB)

(73) Assignee: Rolls-Royce PLC, London (GB)

( * ) Notice: Subject to any disclaimer, the term of this patent is extended or adjusted under 35 U.S.C. 154(b) by 765 days.

(21) Appl. No.: 12/861,560

(22) Filed: Aug. 23, 2010

(65) Prior Publication Data

US 2011/0058958 A1 Mar. 10, 2011

(30) Foreign Application Priority Data

Sep. 9, 2009 (GB) ..... 0915680.3

(51) Int. Cl.
*F01D 5/18* (2006.01)

(52) U.S. Cl.
USPC ..... 415/115; 415/116; 416/96 R

(58) Field of Classification Search
USPC ..... 415/115, 116; 416/96 A, 97 R, 97 A, 232
See application file for complete search history.

(56) References Cited

U.S. PATENT DOCUMENTS

| | | | |
|---|---|---|---|
| 5,073,086 A | 12/1991 | Cooper | |
| 5,536,143 A | 7/1996 | Jacala et al. | |
| 2005/0281674 A1 | 12/2005 | Liang | |

FOREIGN PATENT DOCUMENTS

| | | | | |
|---|---|---|---|---|
| EP | 1 116 861 A2 | | 7/2001 | |
| EP | 1 659 263 A2 | | 5/2006 | |
| EP | 1 783 327 A2 | | 5/2007 | |
| EP | 1 923 537 A2 | | 5/2008 | |
| JP | 2004132218 A | * | 4/2004 | ..... F01D 5/18 |
| JP | A-2004-132218 | | 4/2004 | |

OTHER PUBLICATIONS

British Search Report issued in British Application No. GB0915680.3 dated Dec. 17, 2009.
Sep. 11, 2013 European Search Report issued in European Application No. 10 17 3689.

* cited by examiner

*Primary Examiner* — Edward Look
*Assistant Examiner* — Juan G Flores
(74) *Attorney, Agent, or Firm* — Oliff PLC

(57) ABSTRACT

An aerofoil blade or vane suitable for the turbine of a gas turbine engine includes an extending aerofoil portion having facing wall parts interconnected by a divider member to partially define first and second cooling fluid passage portions. The first and second passage portions are interconnected in a series fluid flow relationship by a bend passage portion. The first passage portion directs cooling fluid to the bend portion and the second passage portion exhausts cooling fluid from the bend portion. The divider member provides a localised contraction of the downstream end of the first passage portion to accelerate the cooling fluid flow before it enters the bend passage portion. The divider member provides a localised progressive series narrowing and opening of the upstream end of the second passage portion in the general direction of cooling fluid flow.

12 Claims, 5 Drawing Sheets

COOLED AEROFOIL BLADE OR VANE

FIELD OF THE INVENTION

The present invention relates to a cooled aerofoil blade or vane for use in gas turbine engines.

BACKGROUND OF THE INVENTION

The turbines used in modern gas turbine engines are required to operate at extremely high temperatures. In order for the aerofoil blades or vanes present in those turbines to withstand such high temperatures, it is necessary to cool them. This is typically achieved by providing the blades or vanes with internal passages, through which a cooling fluid, usually air, can be passed.

In order to maximise the efficiency of heat transfer from a blade or vane to the cooling fluid, a single passage may pass through the blade or vane several times. This will inevitably mean that the passages have bends around which the cooling fluid must flow. Unfortunately, as the cooling fluid flows round the bends, it experiences a drop in pressure, which can be particularly large where a bend subtends a large angle (eg 180°). Such pressure drops can be problematic if, for example, the cooling fluid is subsequently required for film cooling of an external surface of the blade or vane. In addition, extra pressure loss may necessitate an increase in coolant pressure, which can in turn increase leakage in the system and directly affect engine cycle efficiency. Film cooling involves the fluid being exhausted through a plurality of small holes connecting the internal cooling passages with the blade/vane exterior. Any loss in pressure when traversing the bends in the passages will reduce the amount of fluid that can be exhausted to the blade/vane exterior, so reducing the overall film cooling.

Several methods of reducing the loss in pressure caused by bends in the cooling passages have been suggested. One example is to provide turning vanes in the bends. Although these reduce the overall pressure loss, they increase the weight of the blade or vane and its manufacturing complexity. Another possibility is to vary the shape of a wall member that divides the two passage portions on either side of a bend. U.S. Pat. No. 5,073,086 describes an aerofoil blade having pressure and suction flanks, in which the flanks are interconnected internally of the aerofoil portion by a generally longitudinally extending wall member to partially define first and second cooling fluid passage portions. The first and second passage portions are interconnected in series fluid flow relationship by a bend passage portion, and the wall member is locally thickened in the region of the bend passage portion to provide a localised progressive series narrowing and opening of the upstream end of the second passage portion in the general direction of cooling fluid flow.

However, there is a continuing need to minimise the loss in pressure experienced when the coolant flows round a bend in the cooling passage.

SUMMARY OF THE INVENTION

A first aspect of the invention provides an aerofoil blade or vane suitable for the turbine of a gas turbine engine including:

a longitudinally extending aerofoil portion having facing wall parts, the wall parts being interconnected by a generally longitudinally extending divider member to partially define first and second cooling fluid passage portions disposed in side-by-side generally longitudinally extending relationship, the first and second passage portions being interconnected in series fluid flow relationship by a bend passage portion, the first passage portion being adapted to direct cooling fluid to the bend passage portion and the second passage portion being adapted to exhaust cooling fluid from the bend passage portion, the divider member having a first local thickening in the region of the bend passage portion to provide a localised contraction of the downstream end of the first passage portion to accelerate the cooling fluid flow before it enters the bend passage portion, and the divider member having a second local thickening in the region of the bend passage portion to provide a localised progressive series narrowing and opening of the upstream end of the second passage portion in the general direction of cooling fluid flow.

The present invention can help to reduce the loss in pressure that occurs when coolant passes round a bend. Using this geometry, the flow can be accelerated by contracting the flow path before the flow starts to turn, increasing the flow momentum and promoting a favourable pressure gradient on the inside wall of the bend.

The blade or vane may include any one or any combination of the following optional features.

Typically, the wall parts respectively form the pressure and surface flanks of the aerofoil portion.

The first local thickening of the divider member may be greater along the centre line of the divider member than along the edges of the divider member where the divider member connects with the wall parts. By increasing the thickening of the divider member along its centre line, the contraction of the flow in a region midway between the facing wall parts can be made to occur earlier than the contraction which occurs where the divider member meets those wall parts. As an effect of symmetric secondary flows, the middle region of the first passage portion typically has less momentum or less attached flow compared to the side regions. The differential thickening of the divider member can control the flow momentum locally.

More specifically, without this increased thickening along the centre line, the flow attached to the wall parts can overturn because boundary layers at the wall parts tend to cause the flow to have less momentum than the flow away from the wall parts. Overturning of the flow can produce a pair of counter-rotating vortices. However, the thickening along the centre line produces turning of the flow towards the wall parts in the opposite sense to the counter-rotating pair, and thus helps to eliminate or reduce the strength of such vortices. In addition, the thickening along the centre line helps to increase the radius of curvature of the divider member around the bend passage portion, which can reduce a tendency for the flow to separate from the surface of the divider member after the bend due to an adverse pressure gradient at the centre line.

Preferably, the first local thickening pre-turns the flow in the opposite sense to the turn of the bend passage portion. This also helps to increase the radius of curvature of the divider member around the bend passage portion.

The second local thickening of the divider member may be reduced along the centre line of the divider member relative to along the edges of the divider member where the divider member connects with the wall parts. This shape helps direct the secondary flows in this region, reducing the tendency of the flow to separate from the surface of the dividing member under the adverse pressure gradient.

The second local thickening of the divider member may have a portion in which the thickening is greatest at positions between the centre line of the divider member and the edges. By increasing the thickness of the divider member between the centre line and the edges, it is possible for the second passage portion to have acute angles, ie to define cusps, at the boundaries between the divider member and the facing wall parts. The cusps can interact with secondary flows which form on the wall portions and the inner surface of the bend in a way that reduces the extent of separated flow, ie the flow can be helped to remain attached to the inner wall, allowing it to be slowed down reversibly. The promotion of reversible diffusion can allow the static pressure to increase and helps reduce the net total pressure loss caused by the bend.

The bend passage portion may be located adjacent one of the longitudinal extents of the aerofoil portion, and, in the case of a blade, preferably adjacent the radially inward extent when the blade is mounted in the turbine of a gas turbine engine.

Typically, the first and second passage portions are parallel with each other.

A second aspect of the invention provides a gas turbine engine having one or more aerofoil blades and/or vanes according to the first aspect of the invention, and the or each blade or vane optionally having any one or combination of the optional features described above in relation to the first aspect.

A third aspect of the invention provides a fluid flow conduit having first and second substantially straight flow passage portions interconnected in series fluid flow relationship by a bend passage portion which turns the fluid flow through at least 90° (although preferably through at least 135° and more preferably through about 180°), the first passage portion being adapted to direct fluid to the bend passage portion and the second passage portion being adapted to exhaust fluid from the bend passage portion, wherein the first and second flow passage portions and the bend passage portion are partially defined by: two substantially parallel side walls, and an inside bend wall which connects the side walls along the first and second flow passage portions and forms the inside of the bend made by the bend passage portion, and wherein the inside bend wall has a first local prominence in the region of the bend passage portion to provide a localised contraction of the downstream end of the first passage portion to accelerate the fluid flow before it enters the bend passage portion, and the inside bend wall has a second local prominence in the region of the bend passage portion to provide a localised progressive series narrowing and opening of the upstream end of the second passage portion in the general direction of fluid flow.

Thus an example of the fluid flow conduit can be provided by the passage portions of an aerofoil blade or vane of the first aspect, the first and second substantially straight flow passages and bend passage portion of the third aspect being respectively the first and second cooling fluid passage portions and bend passage portions of the first aspect, the two substantially parallel side walls of the third aspect being the facing wall parts of the first aspect, the inside bend wall of the third aspect being formed by a surface of the divider member of the first aspect, and the first and second local prominences of the third aspect being provided by respectively the first and second local thickenings of the first aspect.

Moreover, the fluid flow conduit may have any one or any combination of suitable optional features described above in relation to the first aspect. For example, the first local prominence may be higher along the centre line of the inside bend wall than along the edges of the inside bend wall where the inside bend wall connects with the side walls. The first local prominence may pre-turn the flow in the opposite sense to the turn of the bend passage portion. The second local prominence may be reduced along the centre line of the inside bend wall relative to along the edges of the inside bend wall where the inside bend wall connects with the side walls. The second local prominence may have a portion in which the prominence is higher at positions between the centre line of the inside bend wall and the edges of the inner wall where the inside bend wall connects with the side walls.

The fluid flow conduit can have wider fields of application than carrying cooling fluid through an aerofoil blade or vane. In particular, the fluid flow conduit can be used beneficially in other fields where tight fluid flow turns have to be made, and it is desirable to reduce pressure losses.

Thus, by way of example, the fluid flow conduit can be a conduit in an air conditioning system, in a heat exchanger (such as a cross flow heat exchanger), in a hydro-electric installation, in an automotive intercooler or exhaust system, or in an industrial or domestic plumbing system.

BRIEF DESCRIPTION OF THE DRAWINGS

Embodiments of the invention will now be described by way of example with reference to the accompanying drawings in which.

DETAILED DESCRIPTION

Figure 1:
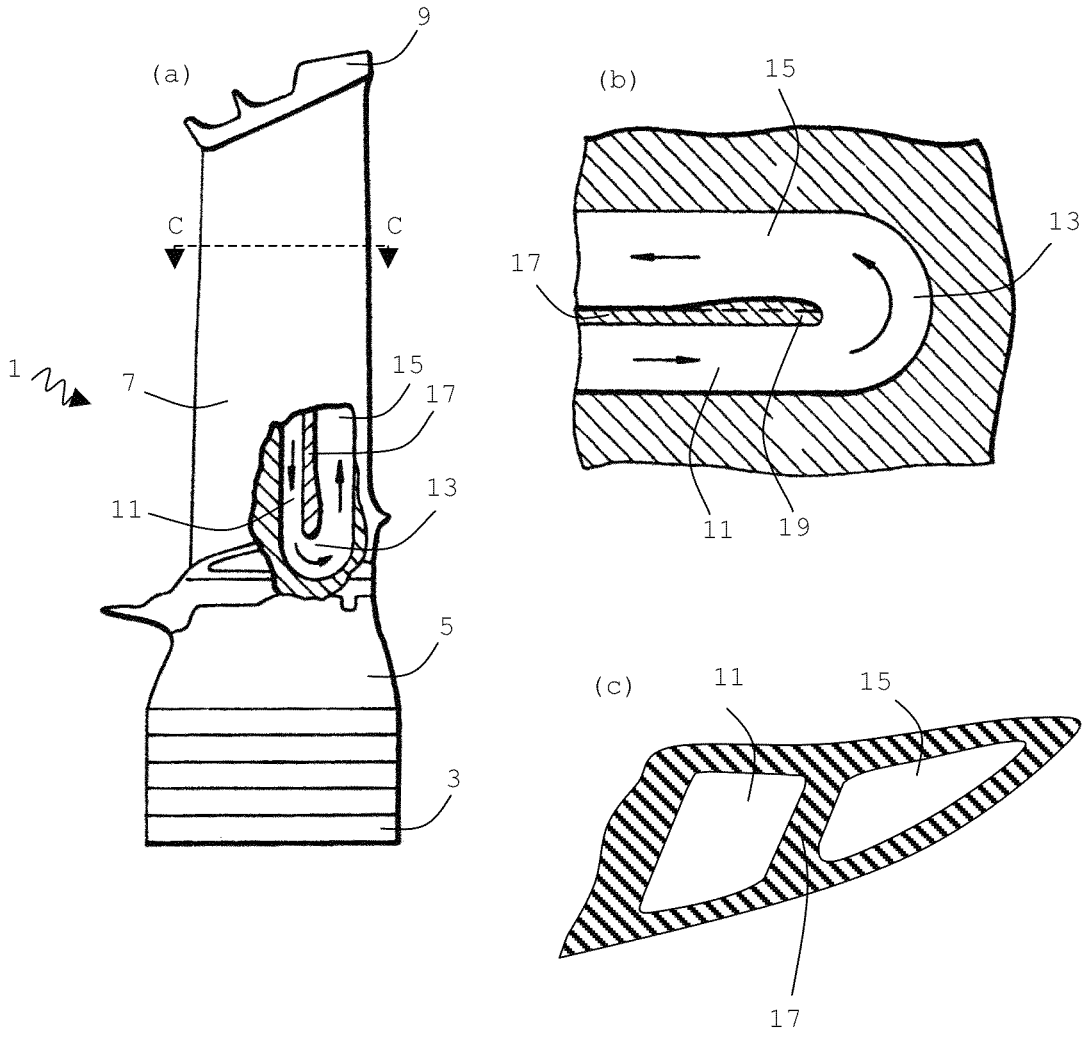
FIG. 1 shows (a) a partially sectioned side view of a conventional aerofoil blade, (b) a view on an enlarged scale of the partially sectioned portion of the aerofoil blade, and (c) a view on section line C-C.

FIG. 1(*a*) shows a conventional aerofoil blade 1 for the high pressure turbine of a gas turbine engine. The blade is mounted with a plurality of similar blades on the periphery of a disc which rotates within the gas turbine engine. The blade comprises a root portion 3 for attachment to the disc. A platform 5 is located radially outward of the root portion, and an aerofoil portion 7 is located radially outward of the platform. A shroud portion 9 is located on the radially outmost extent of the aerofoil portion. The shroud and platform serve to define a portion of the turbine gas passage in which the aerofoil portion is located. Since the gases which flow over the aerofoil portion are usually at very high temperature, the aerofoil portion has interior passages through which a coolant, typically air, can circulate. The air flows through the passages before being ejected from the blade. The arrows show the direction of flow through the passages.

In order to cool the blade effectively, the interior passages make several passes through the blade. This requires the coolant to follow a U-shaped path as it completes one pass and begins another. Such a path is shown in FIGS. 1(*a*) and 1(*b*). The coolant flows in a generally radially inward direction through a generally longitudinally extending first passage portion 11 until it reaches a bend 13 in the region of the blade platform. The bend turns the coolant through a 180° angle to exhaust it into a second passage portion 15, through which it flows in a radially outward direction. The first and second passage portions are in a side-by-side relationship. The passage portions are divided and partially defined by a longitudinal divider member 17 which is generally planar in configuration. An end 19 of the divider member is locally thickened in the region of the bend portion to provide a localised narrowing and opening of the upstream end of the second passage portion in the general direction of cooling fluid flow. FIG. 1(*c*) shows a cross section along the line C-C in FIG. 1(*a*).

Figure 2:
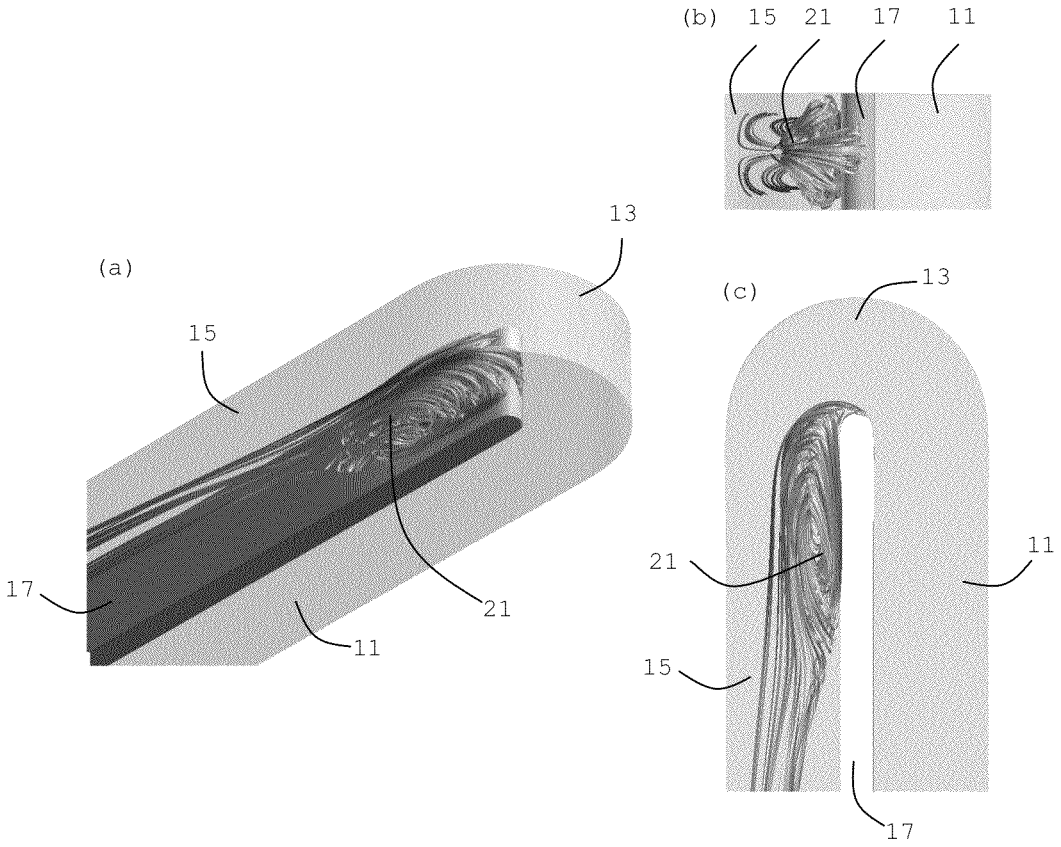
FIG. 2 shows (a) an isometric view of a cooling passage having a conventional bend geometry with simulated flow paths for coolant travelling through the passage, (b) an end-on view of the cooling passage and simulated flow paths, and (c) a longitudinal cross section of the cooling passage and simulated flow paths.

FIG. 2 shows CFD simulated flow paths for a coolant traversing a bend in a conventional aerofoil blade cooling passage. FIG. 2(*a*) shows an isometric projection of the bend, FIG. 2(*b*) shows an end on view of the bend, and FIG. 2(*c*) shows a longitudinal cross section of the bend. The cooling passage is similar to that shown in FIG. 1, but without the local thickening at the end of the divider member. Features in FIG. 2 labelled with the same numbers as FIG. 1 correspond to equivalent parts of the cooling passage. FIG. 2 shows that the flow passing around the inside of the bend is retarded on entering the second passage portion, separates from the divider member and forms large eddy currents 21.

Figure 3:
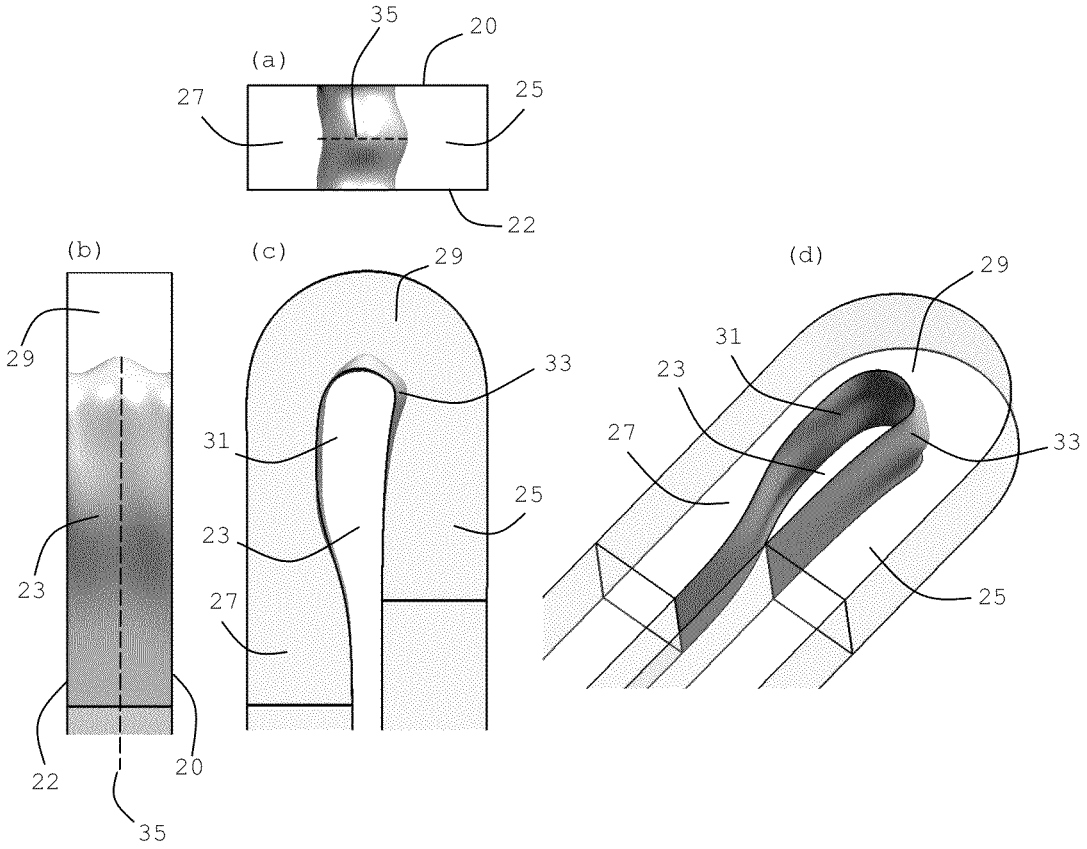
FIG. 3 shows (a) an end-on view of an aerofoil blade cooling passage having a bend geometry according to an embodiment of the present invention, (b) a side view of the cooling passage, (c) a longitudinal cross section of the cooling passage, and (d) an isometric view of the cooling passage.

FIG. 3 shows views of an aerofoil blade cooling passage having a bend geometry according to an embodiment of the present invention. The blade has facing wall parts 20, 22 that are interconnected by a generally longitudinally extending divider member 23 to partially define first 25 and second 27 cooling fluid passage portions disposed in side-by-side generally longitudinally extending relationship. Typically the wall parts are formed by pressure and suction flanks of the aerofoil portion of the blade. The first and second passage portions are interconnected in series fluid flow relationship by a bend passage portion 29. The first passage portion is adapted to direct cooling fluid to the bend passage portion and the second passage portion is adapted to exhaust cooling fluid from the bend passage portion.

The divider member 23 has a first local thickening 33 in the region of the bend portion to provide a localised contraction of the downstream end of the first passage portion. The first local thickening helps to accelerate the cooling fluid flow before it enters the bend passage portion. It also pre-turns the flow in the opposite sense to the turn of the bend passage portion. The divider member also has a second local thickening 31 in the region of the bend portion that provides a localised progressive series narrowing and opening of the upstream end of the second passage portion in the general direction of cooling fluid flow. The shading in FIGS. 3(*a*) and 3(*b*) shows the surface contouring of the divider member on respectively its bend passage portion surface and its first passage portion surface, the contouring arising from local variations in the thickness of the divider member. The surface of the divider member 23 may be considered as an inside bend wall connecting the wall parts 20, 22 along the first 25 and second 27 flow passage portions and forming the inside of the bend made by the bend passage portion 29, the first 33 and second 31 local thickenings forming respective local prominences on the inside bend wall.

Shown as a dashed line in FIGS. 3(*a*) and 3(*b*), the divider member has a centre line 35 which runs along its surface, midway between the facing wall parts. The first local thickening 33 of the divider member is greater along the centre line of the divider member than along the edges of the divider member where it connects with the wall parts. The flow path is therefore contracted earlier in the region midway between the facing wall parts than in the region where the divider member meets the facing wall parts. The convex shape of the divider member surface at its centre line at the first local thickening eases the passage of the flow towards the facing wall parts, which reduces the strength of the secondary flows on those parts. Pre-turning the flow in the opposite sense to the turn of the bend passage portion also reduces a tendency for the flow to separate from the surface of the divider member after the bend due to an adverse pressure gradient at the centre line.

Figure 4:
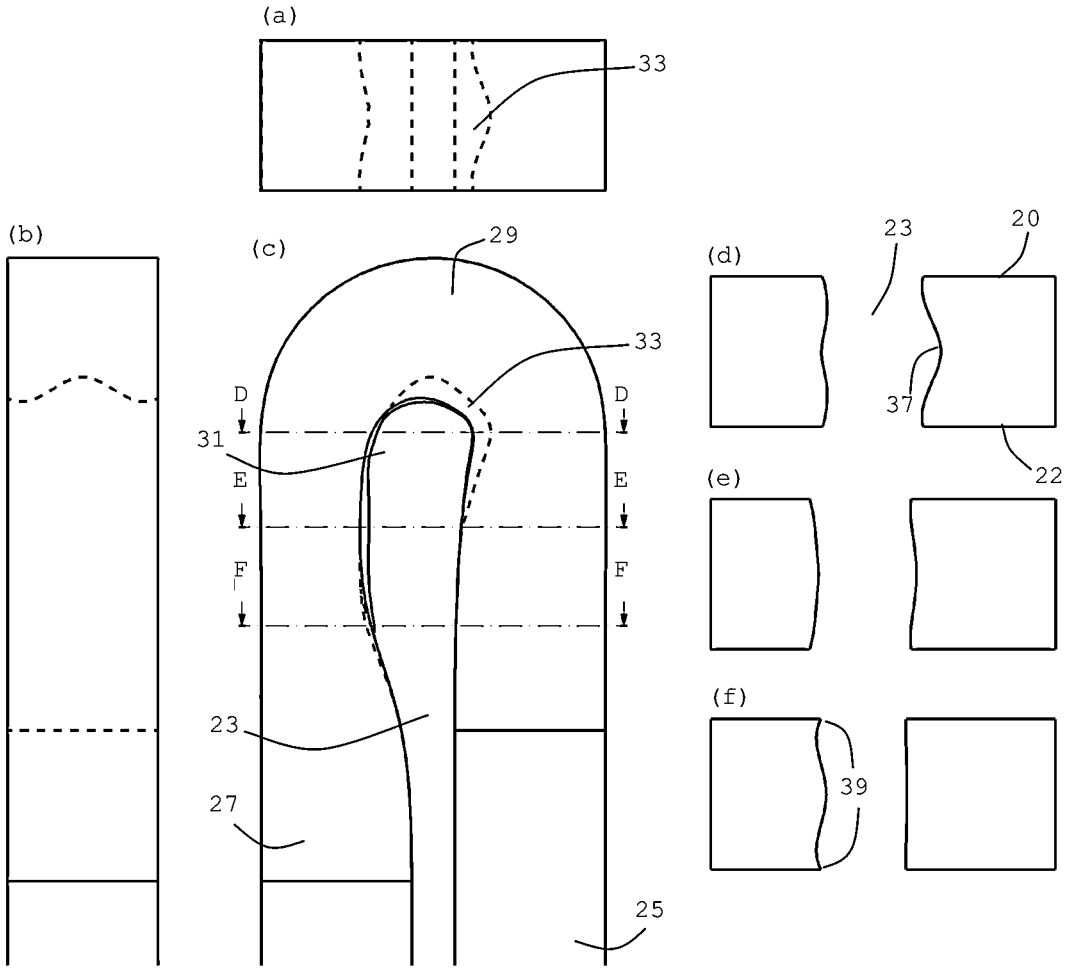
FIG. 4 shows (a) an end-on view of an aerofoil blade cooling passage having a bend geometry according to the embodiment, (b) a side view of the cooling passage, (c) a longitudinal cross section of the cooling passage, (d) a view on section line D-D, (e) a view on section line E-E of FIG. 4(*c*, and (f) a view on section line F-F.

FIG. 4 shows how the contraction in the flow path varies throughout the course of the bend. The local variations in thickness of the divider member shape the inside walls of the passage portions, and cause the flow path to narrow to different extents depending on the lateral distance from the facing wall parts. The first local thickening of the divider member is greater along the centre line of the divider member than along the edges of the divider member where the divider member connects with the wall parts. FIG. 4(*d*) shows how this causes a narrowing 37 of the flow path in the first fluid passage portion which is greater towards the centre line of the divider member than at the edges where the divider member connects with the wall parts.

FIGS. 4(*e*) and 4(*f*) show cross sections taken through the cooling passage at distances further away from the bend than that shown in 4(*d*). In FIG. 4(*e*), the second local thickening of the divider member is reduced along the centre line of the divider member relative to along the edges where the divider member connects with the facing wall parts, and so the flow path in this portion of the second fluid passage portion is less narrowed towards the centre line of the divider member than at the edges where the divider member meets the facing wall parts. FIG. 4(*f*) shows that further downstream in the second fluid passage portion, the second local thickening is reduced at the edges where the divider member meets the facing wall parts, and is greatest at positions between the centre line and these edges. FIG. 4(*f*) shows how the second local thickening defines a pair of cusps 39 at the boundaries between the divider member and the facing wall parts in the second fluid passage portion. The cusps can interact with secondary flows which form on the wall portions and the inner surface of the bend in a way that reduces the extent of separated flow, i.e. the flow can be helped to remain attached to the inner wall, allowing it to be slowed down reversibly.

Figure 5:
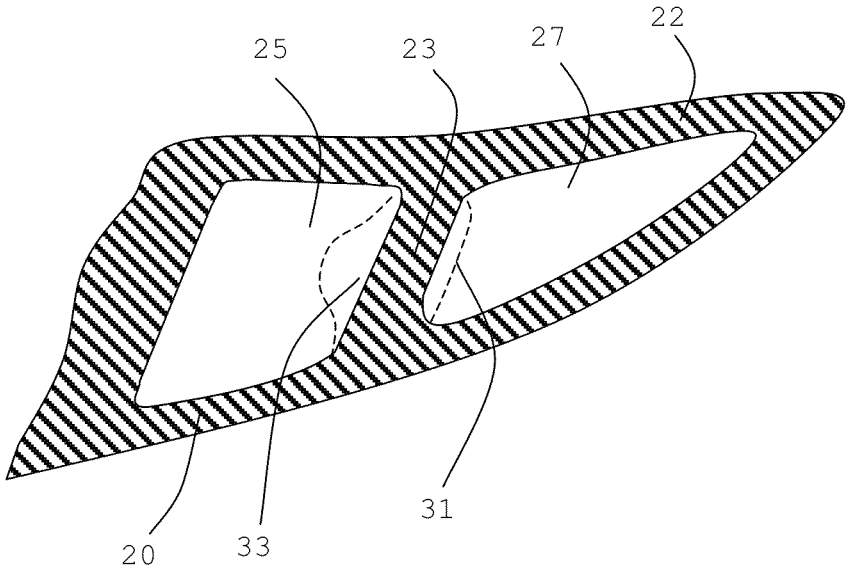
FIG. 5 shows a cross section through an aerofoil blade having a cooling passage with a bend geometry according to the present invention.

FIG. 5 shows a cross section through an aerofoil blade having a cooling path geometry according to the present invention. The fluid flows through the first fluid passage portion 25 and around a U-bend to return back through the second fluid passage portion 27. The dotted lines 33 and 31 indicate the outline of the respective first and second local thickenings of the divider member 23 that the fluid encounters as it circulates around the U-bend. The wall parts 20, 22 are respectively formed in this case by suction and pressure flanks of the aerofoil portion of the blade.

Figure 6:
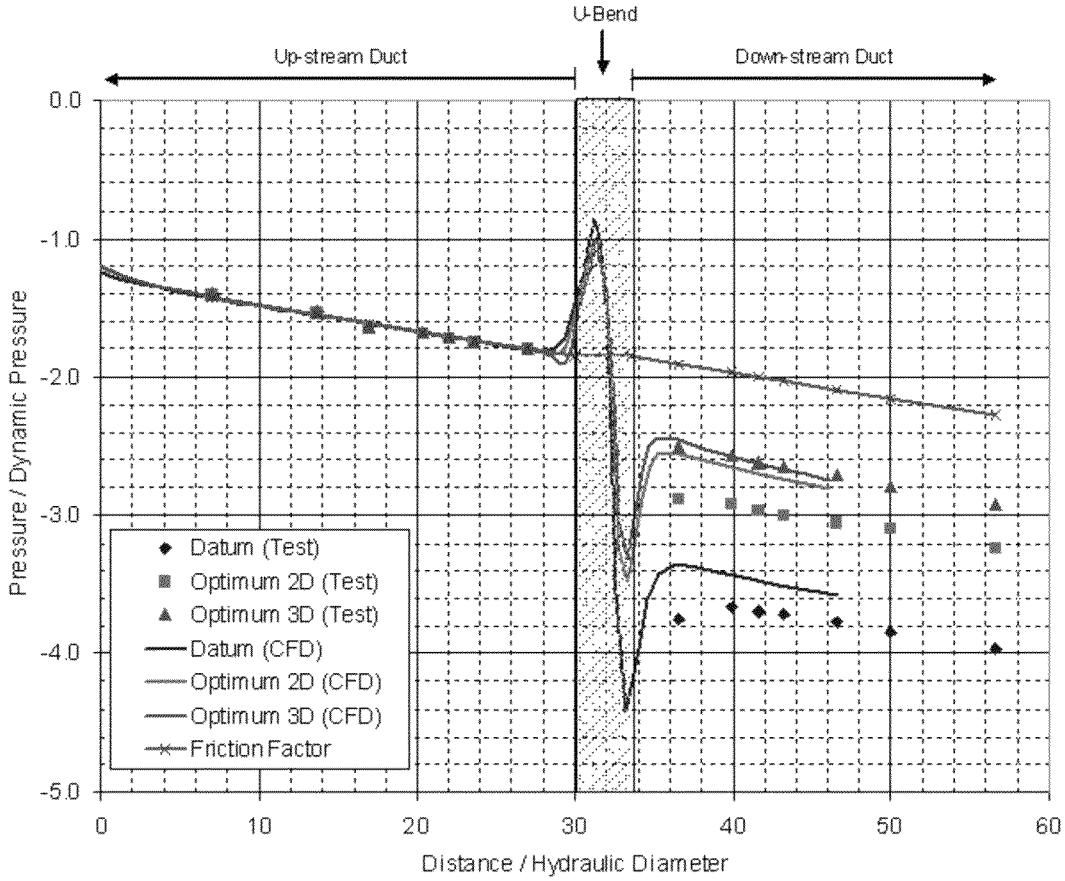
FIG. 6 shows a plot of static pressure divided by dynamic head (vertical axis) against distance along passage divided by passage hydraulic diameter (horizontal axis) for fluid flows along experimental and CFD (computation fluid dynamics) predicted passages.

CFD and experimental studies were performed to demonstrate the advantageous results, relative to reference passages, obtained with a passage having the divider member, first and second cooling fluid passage portions, and a 180° bend passage portion of the present invention. FIG. 6 summarises the results of the studies and shows a plot of static pressure divided by dynamic head against distance along passage divided by passage hydraulic diameter.

The CFD predicted line and experimental points labelled "Friction Factor" are results for a reference straight passage of square cross-section. For this passage the correspondence between prediction and experiment was very good. The other results are for passages in which the first passage portion begins at the left hand end of the horizontal axis, the bend passage extends from about 30 to about 35 on the horizontal axis, and the second passage portion extends to the right hand end of the horizontal axis. The CFD predicted line and experimental points labelled "Datum" are results for a passage in which there were no local thickenings in the region of the bend portion. The CFD predicted line and experimental points labelled "Optimum 2D/Opt 2D" are results for a 2D passage in which there were local thickenings in the region of the bend portion according to the present invention. The CFD predicted line and experimental points labelled "Optimum 3D/Opt 3D" are results for a 3D passage in which there were local thickenings in the region of the bend portion according to the present invention.

In the results for all passages, a reduction in the static pressure/dynamic head produced by the bend portion is evident. The losses incurred at the bend portions produced a significant reduction in the static pressure/dynamic head in the second passage portion relative to the reference straight passage.

However, both the CFD predicted results and the experimental results the divider member show that the losses were significantly reduced when the divider member had local thickenings in the region of the bend portion according to the present invention. The differences between the CFD predicted results and the experimental results for a particular passage are probably due to the difficulty of completely accurately predicting the complex flows which occur at the bend portion. However, encouragingly, trends which are seen in the CFD predicted results are also seen in the experimental results.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention. Although the present invention has been described with reference to air cooled aerofoil rotor blades, it will be appreciated that it is also applicable to stator vanes for use in the turbine of a gas turbine engine. It will also be appreciated that although the present invention has been described with reference to blades or vanes have a cooling air path which turns through 180°, it is also relevant to blades or vanes in which the cooling air flow is turned through angles which are somewhat less than 180°. More generally, a fluid flow conduit can be provided having advantageous pressure-loss reducing features equivalent to those associated with a bend made by an interior passage of a rotor blade or vane of the present invention described above, but for use in other technical fields where tight (ie at least) 90° fluid flow turns have to be made.

All references referred to above are incorporated by reference.

The invention claimed is:

1. An aerofoil blade or vane suitable for the turbine of a gas turbine engine, comprising:

a longitudinally extending aerofoil portion having facing wall parts, the wall parts being interconnected by a generally longitudinally extending divider member to partially define first and second cooling fluid passage portions disposed in side-by-side generally longitudinally extending relationship, the first and second passage portions being interconnected in series fluid flow relationship by a bend passage portion, the first passage portion being adapted to direct cooling fluid to the bend portion and the second passage portion being adapted to exhaust cooling fluid from the bend portion, the divider member having a first local thickening in the region of the bend portion to provide a localised contraction of the downstream end of the first passage portion to accelerate the cooling fluid flow before it enters the bend passage portion, and the first local thickening of the divider member being greater along the centre line of the divider member than along the edges of the divider member where the divider member connects with the wall parts, and the divider member having a second local thickening in the region of the bend portion to provide a localised progressive series narrowing and opening of the upstream end of the second passage portion in the general direction of cooling fluid flow.

2. An aerofoil blade or vane according to claim 1, wherein over at least a portion of the second local thickening of the divider member, the thickening is reduced along the centre line of the divider member relative to along the edges of the divider member where the divider member connects with the wall parts.

3. An aerofoil blade or vane according to claim 2, wherein over at least a portion of the second local thickening of the divider member, the thickening is greatest at positions between the centre line and the edges.

4. An aerofoil blade or vane according to claim 1, wherein the wall parts respectively form the pressure and suction flanks of the aerofoil portion.

5. An aerofoil blade or vane according to claim 1, wherein the first local thickening pre-turns the flow in the opposite sense to the turn of the bend passage portion.

6. A gas turbine engine having one or more aerofoil blades and/or vanes according to claim 1.

7. An aerofoil blade or vane suitable for the turbine of a gas turbine engine, comprising:

a longitudinally extending aerofoil portion having facing wall parts, the wall parts being interconnected by a generally longitudinally extending divider member to partially define first and second cooling fluid passage portions disposed in side-by-side generally longitudinally extending relationship, the first and second passage portions being interconnected in series fluid flow relationship by a bend passage portion, the first passage portion being adapted to direct cooling fluid to the bend portion and the second passage portion being adapted to exhaust cooling fluid from the bend portion, the divider member having a first local thickening in the region of the bend portion to provide a localised contraction of the downstream end of the first passage portion to accelerate the cooling fluid flow before it enters the bend passage portion, and the divider member having a second local thickening in the region of the bend portion to provide a localised progressive series narrowing and opening of the upstream end of the second passage portion in the general direction of cooling fluid flow, over at least a portion of the second local thickening of the divider member, the thickening being reduced along the centre line of the divider member relative to along the edges of the divider member where the divider member connects with the wall parts.

8. An aerofoil blade or vane according to claim 7, wherein the first local thickening of the divider member is greater along the centre line of the divider member than along the edges of the divider member where the divider member connects with the wall parts.

9. An aerofoil blade or vane according to claim 7, wherein over at least a portion of the second local thickening of the divider member, the thickening is greatest at positions between the centre line and the edges.

10. An aerofoil blade or vane according to claim 7, wherein the wall parts respectively form the pressure and suction flanks of the aerofoil portion.

11. An aerofoil blade or vane according to claim 7, wherein the first local thickening pre-turns the flow in the opposite sense to the turn of the bend passage portion.

12. A gas turbine engine having one or more aerofoil blades and/or vanes according to claim 7.

* * * * *